US010118409B2

(12) United States Patent
Leighton et al.

(10) Patent No.: US 10,118,409 B2
(45) Date of Patent: Nov. 6, 2018

(54) CARBON FILAMENT LAMP ARRAY

(71) Applicant: Xerox Corporation, Norwalk, CT (US)

(72) Inventors: Roger G. Leighton, Hilton, NY (US); Paul M. Fromm, Rochester, NY (US); Robert P. Herloski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/429,896

(22) Filed: Feb. 10, 2017

(65) Prior Publication Data

US 2017/0341450 A1 Nov. 30, 2017

Related U.S. Application Data

(60) Provisional application No. 62/342,629, filed on May 27, 2016.

(51) Int. Cl.
*B41J 11/00* (2006.01)
*B41M 7/00* (2006.01)

(52) U.S. Cl.
CPC ..... *B41J 11/002* (2013.01); *B41M 7/009* (2013.01)

(58) Field of Classification Search
CPC ..... B41M 7/0081; B41M 7/009
See application file for complete search history.

(56) References Cited

U.S. PATENT DOCUMENTS

2009/0207205 A1* 8/2009 Koike ..... B41J 2/16526 347/31
2014/0116276 A1* 5/2014 Bird ..... H04W 4/02 101/424.1

* cited by examiner

*Primary Examiner* — Bradley Thies
(74) *Attorney, Agent, or Firm* — Simpson & Simpson, PLLC

(57) ABSTRACT

A lamp array for drying liquid ink on a media in a printing apparatus. The printing apparatus includes a transport system arranged to move the media through the printing apparatus in a process direction. The lamp array includes at least one lamp having a longitudinal axis arranged in a direction parallel to the process direction and adjacent to the transport system.

10 Claims, 7 Drawing Sheets

CARBON FILAMENT LAMP ARRAY

CROSS-REFERENCE TO RELATED APPLICATIONS

This patent application claims the benefit under 35 U.S.C. § 119(e) of U.S. Provisional Patent Application No. 62/342,629, filed May 27, 2016, which application is incorporated herein by reference.

TECHNICAL FIELD

The presently disclosed embodiments are directed to providing a system for drying liquid inks, and more particularly to a system for drying liquid inks with a lamp array, e.g., carbon filament, oriented in the process direction.

BACKGROUND

Liquid inks, e.g., aqueous and solvent-based inks, require drying time after deposition on a substrate. Factors such as ink composition, substrate characteristics and environmental conditions affect the rate of drying. If sufficient time is available, liquid inks may be permitted to dry without additional actions being taken. However, some situations, e.g., high throughput printing, require that liquid inks dry in an accelerated timeframe.

Some printing systems use heaters, lamps, blowers, etc. to accelerate drying. For example, carbon filament lamps positioned adjacent the substrate pathway after the print zone, i.e., where the printed image is formed, are used to dry liquid inks. Known systems have used carbon filament lamps oriented perpendicular to the process direction of cut sheet media and roll fed media, i.e., oriented in the cross process direction. In the case of cut sheet media, a vacuum transport moves the media from the marking/printing module to an area underneath a set of infrared (IR) lamps to dry the aqueous ink on the media. Depending on the source and type of lamp, the intensity along the length of the lamp may change significantly. Such non-uniformity along the length of a lamp can cause as much as 5-10° C. variation in the cross-process direction. In addition to the non-uniform lamp output, a ray trace of the foregoing lamp arrangement, as depicted in FIG. 3, demonstrates cross-process uniformity challenges as well. These issues are discussed in greater detail below.

Moreover, lamp issues may be more or less prevalent depending on the manufacturer of the lamp. For example, one manufacturer's emitter is a multi-stranded carbon filament under spring tension, while another manufacturer's emitter is a spiral filament that may touch the glass and produce carbon residue on the glass. This residue may contribute to light attenuation and/or create cross-process cold spots.

Furthermore, conventional drying systems provide all media sizes the same power, i.e., an 8.5"×11" media long edge feed leaves 3.4" of transport conveyor exposed to irradiance and overheating of the outboard silicone transport belt, while the same system would have minimal exposed transport conveyor when drying an 8.5"×14" media long edge feed. In short, cross-process orientation of lamp arrays is incapable of accounting for varying paper sizes.

The present disclosure addresses a system and method for drying liquid ink with a size adjustable lamp array which maintains a consistent temperature profile throughout most of the drying zone of a printer system.

SUMMARY

The present system includes a plurality of separately controllable lamps arranged in the process direction, i.e., each lamp's longitudinal axis is aligned with the process direction. The foregoing arrangement overcomes inconsistencies in bulb performance by effectively integrating out such inconsistencies as the printed media travels through the dryer. For example, dark spots generated by the spiral filament touching the glass housing of a lamp are integrated out as the printed media is exposed to the entire length of the lamp during its movement. A further benefit is the present system, due to the process direction orientation of the lamps, permits running the outer lamps at higher wattages than the inner lamps thereby improving cross-process uniformity. Furthermore, the present system permits outer lamps to be turned off and the next most inner lamp driven at a new duty cycle to accommodate shorter media sizes while minimizing degradation to the transport system. Moreover, irradiance fall-off at the end of the heater filament is still 100% usable due to the integration effect mentioned above whereas these low irradiance zones at each end of the cross process oriented lamps need to be outside the paper path where the power uselessly heats the support structure.

Broadly, the present disclosure includes a lamp array for drying a liquid ink on a media in a printing apparatus where the printing apparatus includes a transport system arranged to move the media through the printing apparatus in a process direction. The lamp array includes at least one lamp having a longitudinal axis arranged in a direction parallel to the process direction and adjacent to the transport system.

Additionally, the present disclosure includes a drying system for drying a liquid ink on a media in a printing apparatus where the printing apparatus includes a transport system arranged to move the media through the printing apparatus in a process direction. The drying system includes at least one lamp, a cooling plenum and an exhaust skirt. The at least one lamp includes a longitudinal axis arranged in a direction parallel to the process direction and adjacent to the transport system. The cooling plenum is arranged elevationally above and adjacent to the at least one lamp. The exhaust skirt is arranged adjacent to the cooling plenum.

Moreover, the present disclosure includes a method of drying a liquid ink on a media in a printing apparatus where the printing apparatus includes a transport system and a drying system. The transport system is arranged to move the media through the printing apparatus in a process direction. The drying system includes at least one lamp having a longitudinal axis and adjacent to the transport system, a cooling plenum arranged elevationally above and adjacent to the at least one lamp, and an exhaust skirt arranged adjacent to the cooling plenum. The method includes: positioning the longitudinal axis of the at least one lamp in a direction parallel to the process direction; and, moving the media in the process direction adjacent to the at least one lamp.

Furthermore, the present disclosure includes a lamp array for drying a liquid ink on a web in a printing apparatus where the web moves through the printing apparatus in a process direction. The lamp array includes at least one lamp having a longitudinal axis arranged in a direction parallel to the process direction and in a region within the printing apparatus adjacent to the web.

Other objects, features and advantages of one or more embodiments will be readily appreciable from the following detailed description and from the accompanying drawings and claims.

BRIEF DESCRIPTION OF THE DRAWINGS

Various embodiments are disclosed, by way of example only, with reference to the accompanying drawings in which corresponding reference symbols indicate corresponding parts, in which.

DETAILED DESCRIPTION

Figure 1:
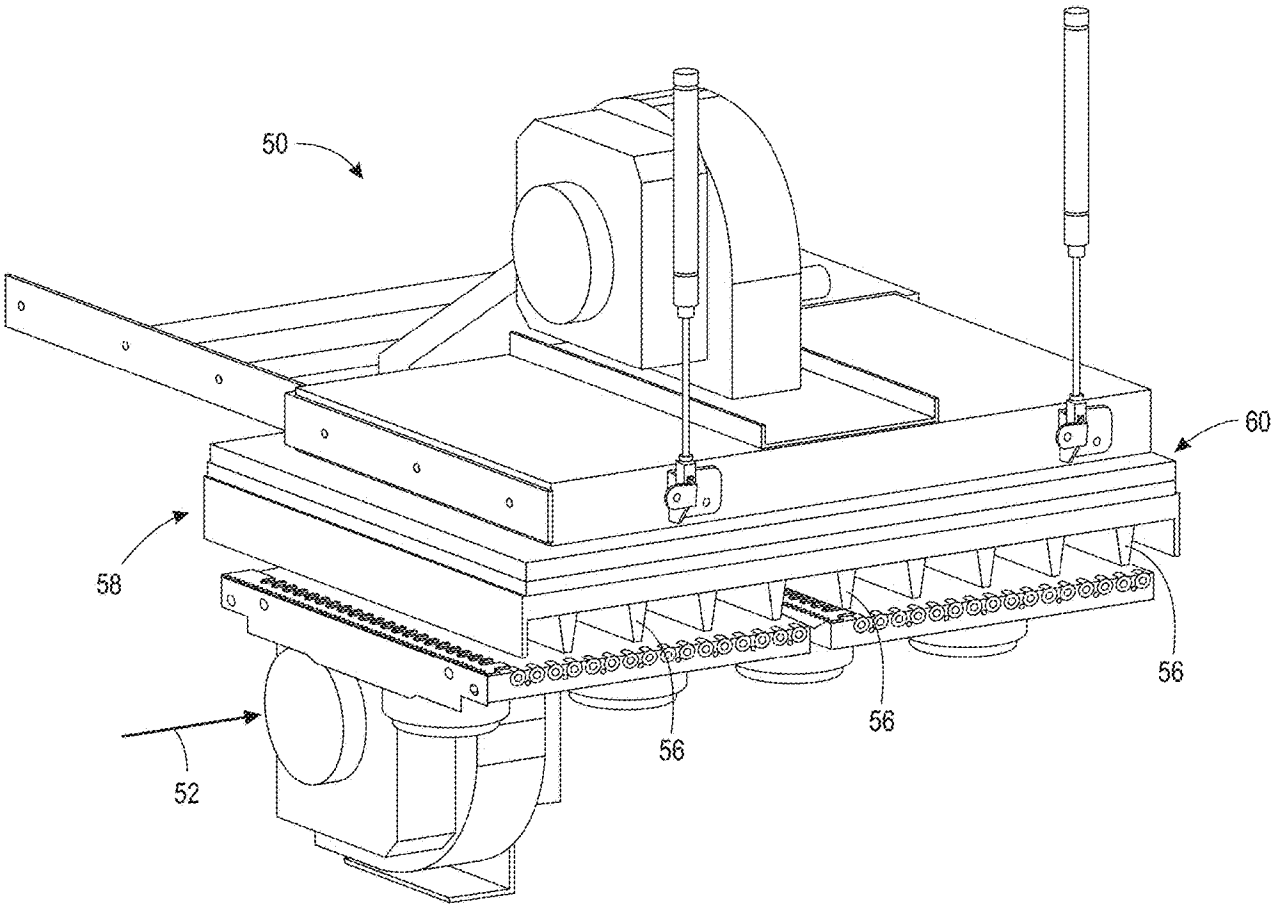
FIG. 1 PRIOR ART
FIG. 1 is a side perspective view of an embodiment of a system for drying liquid ink printed on a media.

At the outset, it should be appreciated that like drawing numbers on different drawing views identify identical, or functionally similar, structural elements of the embodiments set forth herein. Furthermore, it is understood that these embodiments are not limited to the particular methodologies, materials and modifications described and as such may, of course, vary. It is also understood that the terminology used herein is for the purpose of describing particular aspects only, and is not intended to limit the scope of the disclosed embodiments, which are limited only by the appended claims.

Unless defined otherwise, all technical and scientific terms used herein have the same meaning as commonly understood to one of ordinary skill in the art to which these embodiments belong. As used herein, "process direction" is intended to mean the direction of media transport through a printer or copier, while "cross process direction" is intended to mean the perpendicular to the direction of media transport through a printer or copier.

Furthermore, the words "printer," "printer system", "printing system", "printer device" and "printing device" as used herein encompasses any apparatus, such as a digital copier, bookmaking machine, facsimile machine, multi-function machine, etc. which performs a print outputting function for any purpose. Additionally, as used herein, "sheet," "sheet of paper", "paper" and "media" refer to, for example, paper, transparencies, parchment, film, fabric, plastic, photo-finishing papers or other coated or non-coated substrate media in the form of a web upon which information or markings can be visualized and/or reproduced. As used herein, "image" and "printed image" is intended to be broadly construed as any picture, text, character, indicia, pattern or any other printed matter. Printed images can include but are not limited to logos, emblems and symbols. As used herein, the term 'average' shall be construed broadly to include any calculation in which a result datum or decision is obtained based on a plurality of input data, which can include but is not limited to, weighted averages, yes or no decisions based on rolling inputs, etc.

It should be understood that the use of "or" in the present application is with respect to a "non-exclusive" arrangement, unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Moreover, although any methods, devices or materials similar or equivalent to those described herein can be used in the practice or testing of these embodiments, some embodiments of methods, devices, and materials are now described.

Figure 2:
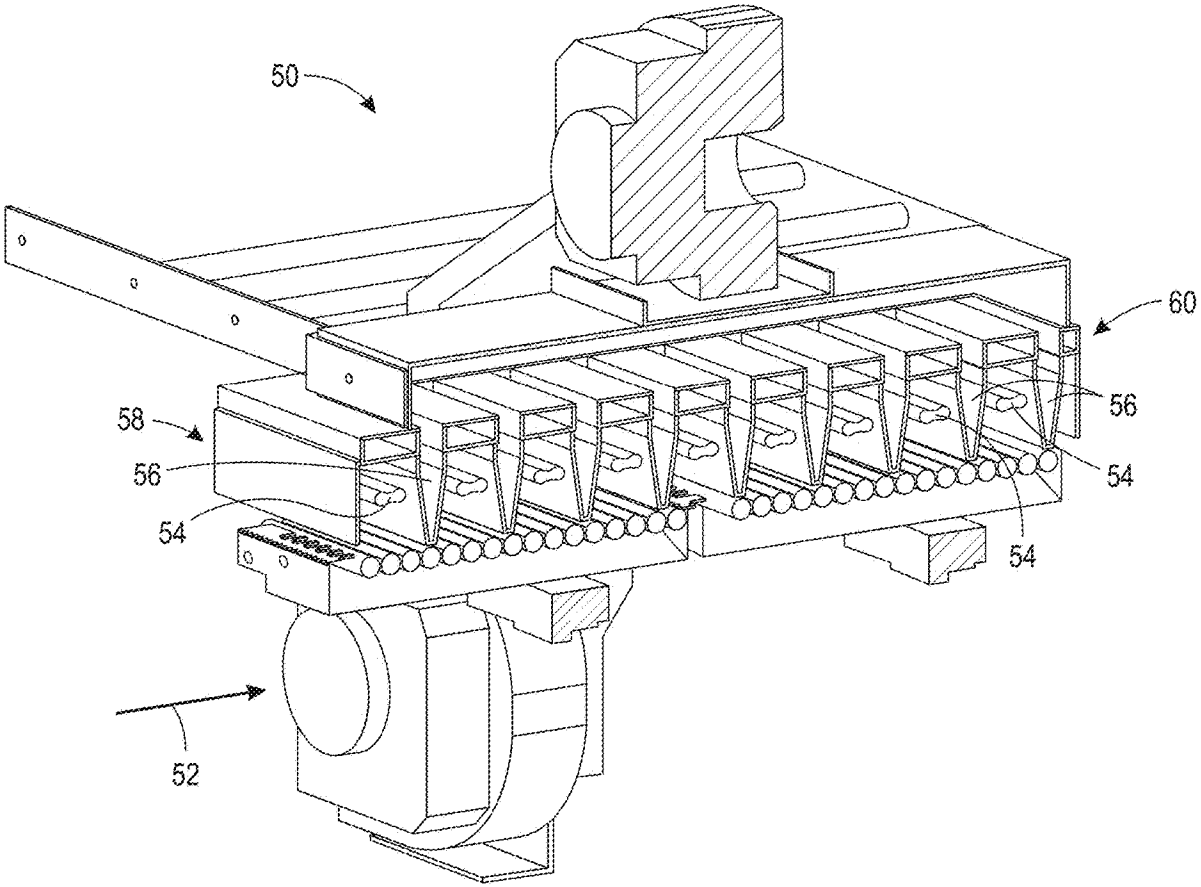
FIG. 2 PRIOR ART
FIG. 2 is a cross sectional view of the system of FIG. 1 taken along a plane located generally at the midpoint between inboard and outboard edges and in the process direction.

FIG. 1 depicts an example system for drying liquid ink comprising cross process oriented lamp arrays, i.e., system 50, while FIG. 2 depicts a cross sectional view of system 50 showing the individual lamps positioned between cooling jets. It should be appreciated that the process direction is indicated by unidirectional arrow 52. Carbon filament IR lamps 54 are interspersed between cooling jets 56. In an attempt to improve the drying efficiency of the system, the first six cooling jets were removed, i.e., the jets closest to end 58 of system 50. Additionally, the last three lamps, i.e., the lamps closest to end 60 of system 50, were removed. The last three jet pairs (six slots) are used to cool the printed media to reduce condensation in the subsequent transport section of the printing system. In the embodiment shown in FIGS. 1 and 2, the lamps are oriented in the cross process direction at an 80 mm pitch.

Figure 3:
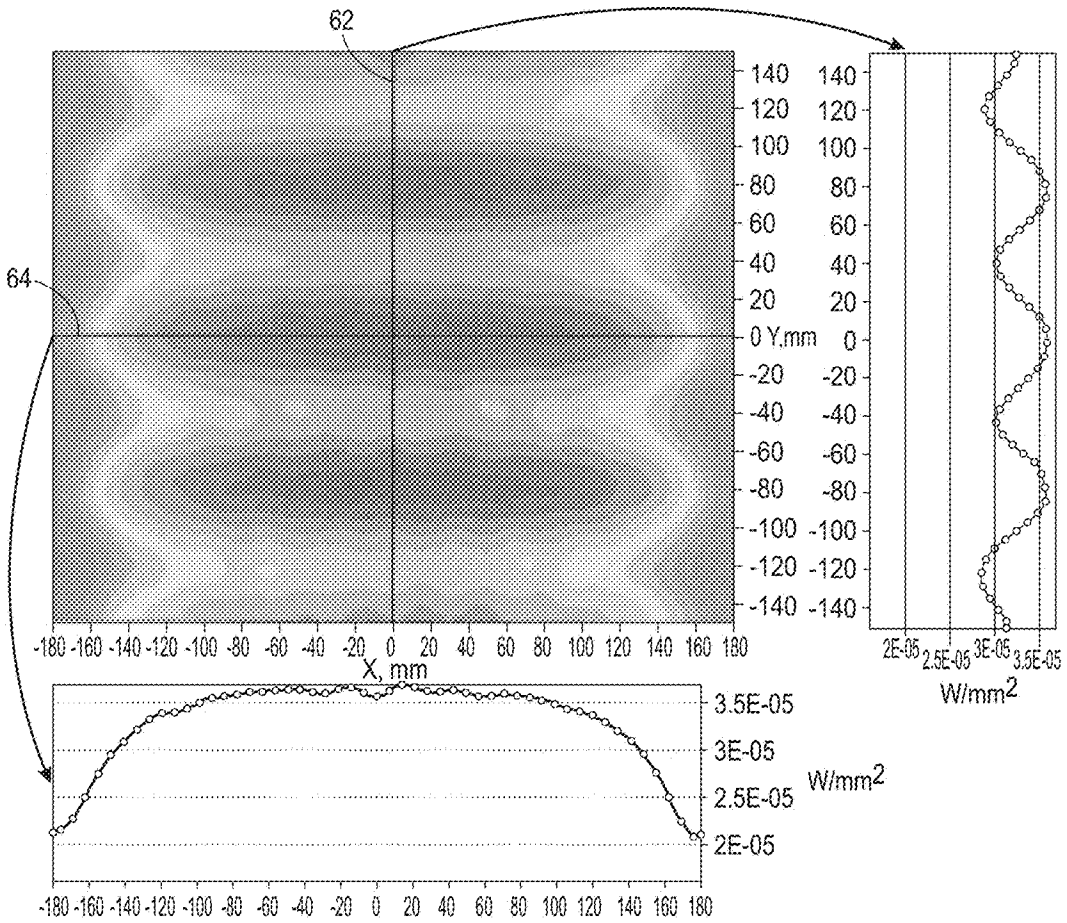
FIG. 3 PRIOR ART
FIG. 3 is a ray trace of the energy output of cross process direction system 50 at the top left, a graphical representation of irradiance taken generally along line 62 of FIG. 3 at the top right (the process direction), and a graphical representation of irradiance taken generally along line 64 of FIG. 3 at the bottom (the cross process direction)

FIG. 3 depicts a ray trace of the energy output of cross process direction system 50 at the top left, depicts a graphical representation of irradiance taken generally along line 62 of FIG. 3 at the top right (the process direction), and depicts a graphical representation of irradiance taken generally along line 64 of FIG. 3 at the bottom (the cross process direction). As is clearly shown in the graphical representations, non-uniform irradiance occurs between lamps in the process direction, i.e., the graphical representation shown in the upper right of FIG. 3. Moreover, irradiance falls off near the ends or edges in the cross process direction, i.e., the graphical representation shown in the bottom of FIG. 3. Thus, the irradiance of system 50 produces uneven temperature gradients across the printed media, especially at the inner and outer edges of the media.

As described above, carbon filament lamps may be configured in a variety of ways. For example, some carbon filament lamps include straight fibers pulled tight under a tension flexure. It has been found that such lamps do not have fibers that droop or touch the interior of the quartz glass housing. Another example of a carbon filament lamp includes a woven spiral filament including a refractory cement to provide stiffness; however, it has been found that lamps of this type have filaments that sag allowing fibers to touch the quartz housing. As these lamps are used, traces of black carbon and/or cement are deposited on the glass housing. These deposits may reduce transmission efficiency, e.g., attenuate total irradiance output, thus requiring an increase in duty cycle to compensate for the decrease in energy reaching the printed media for the purpose of drying a liquid ink.

Figure 4:
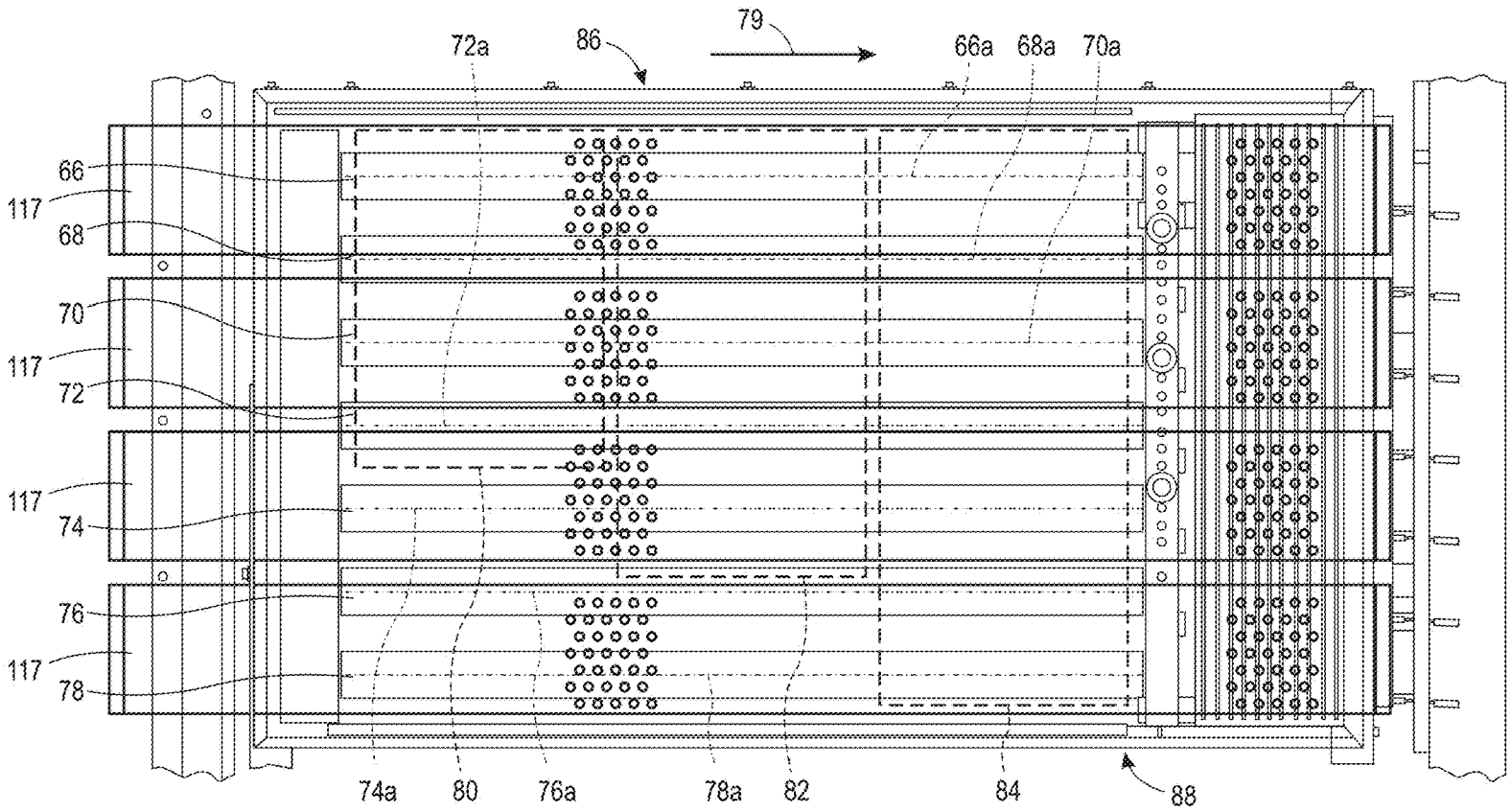
FIG. 4 is a top plan view of an embodiment of a transport system for a present system for drying liquid ink printed on media having a process direction oriented lamp array.
Figure 5:
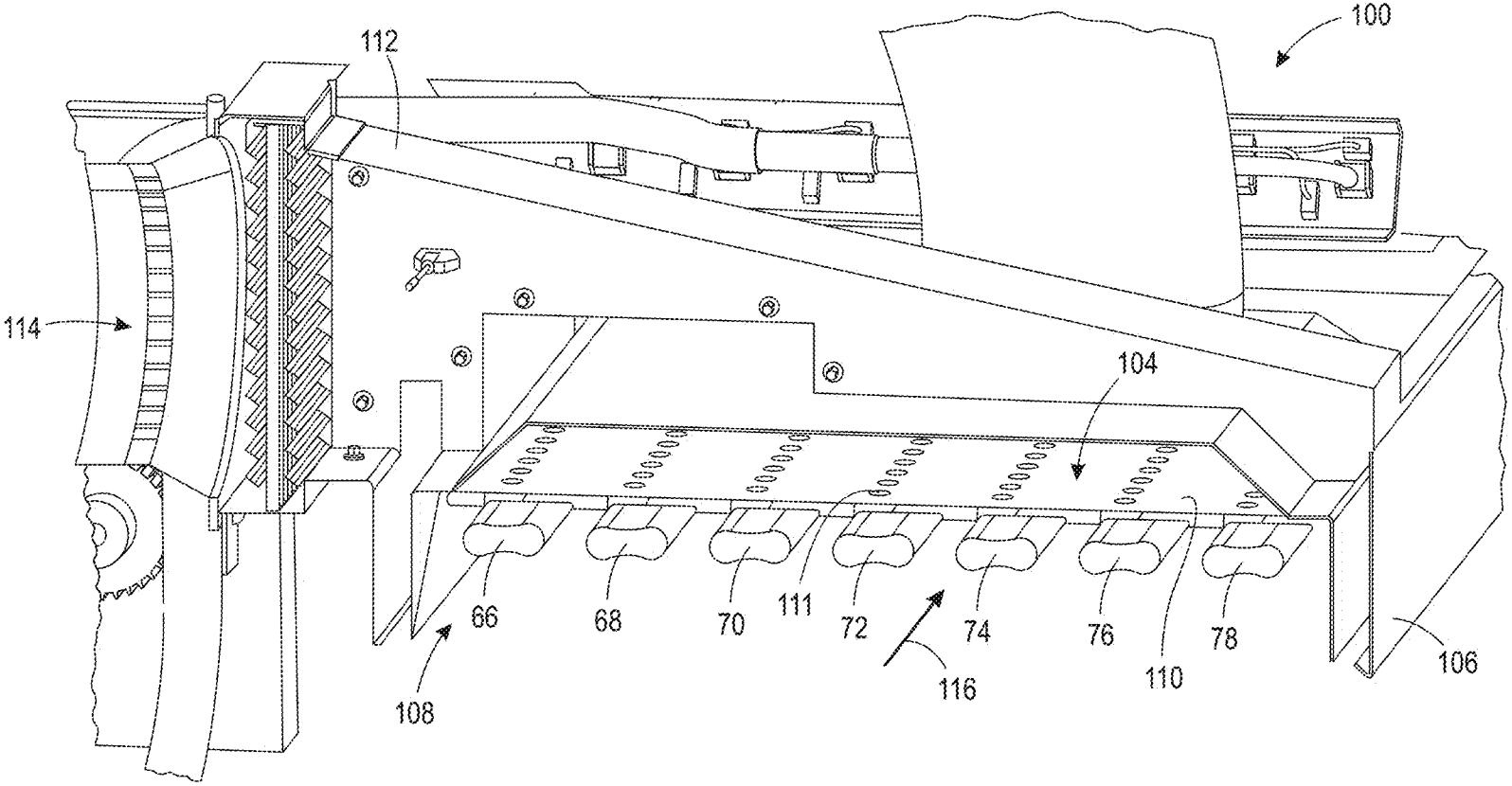
FIG. 5 is a cross sectional view of an embodiment of a system for drying liquid ink printed on a media having a process direction oriented lamp array taken along a plane located generally in the cross process direction.

FIG. 4 depicts lamps 66, 68, 70, 72, 74, 76 and 78 arranged in the process direction, e.g., seven parallel lamps. In other terms, longitudinal axes 66*a*, 68*a*, 70*a*, 72*a*, 74*a*, 76*a* and 78*a* of lamps 66, 68, 70, 72, 74, 76 and 78, respectively, are arranged parallel to the process direction, i.e., the direction depicted by unidirectional arrow 79. As can be seen in FIGS. 4 and 5, in some embodiments, lamps 66, 68, 70, 72, 74, 76 and 78 may be equally spaced relative to each adjacent lamp and/or may be positioned equidistantly relative to each other across the cross process direction, i.e., the direction perpendicular to the process direction. In some embodiments, the lamps are equidistantly positioned substantially across the cross distance of the transport system. It has been found that positioning the lamps in the foregoing arrangement reduces longitudinal non-uniformities thereby reducing drying banding and mottling of the image in the cross process direction. Moreover, it has been found that improved drying leads to reduced contamination throughout the roller nip transports.

Various media sizes, e.g., size 80, 82 and 84, depicted in broken lines in FIG. 4, are each edge registered at outboard edge 86. As can be seen in the figure, media of size 84 will require all lamps to be on for drying, while the lamp furthest from outboard edge 86, i.e., lamp 78, may be turned off for drying media of size 82 and the three lamps furthest from outboard edge 86, i.e., lamps 74, 76 and 78, may be turned off for drying media of size 80.

In some embodiments, lamps that are turned on and closest to outboard edge 86 or inboard edge 88 may be duty cycle modulated to enhance irradiance uniformity across the cross process direction. For example, in some embodiments, lamps located adjacent inboard edge 88 and outboard edge 86 receive 208 volts, e.g., lamps 66 and 78, while interior lamps receive 180 volts, e.g., lamps 68, 70, 72, 74 and 76. It has been found that such an arrangement can maintain an overall gradient across the media of approximately 5° C. or less. It should be appreciated that although only two voltages are described in the prior example, a variety of configurations may be used in the present system. For example, each lamp may have a lesser voltage the closer the lamp is to the center of the media path. Additionally, each lamp may have its own unique voltage in order to account for lamp degradation over time. Thus, for example, if lamp 76 has degraded more than the adjacent lamps, lamp 76 may receive 200 volts while lamps 78 receives 190 volts and lamp 74 receives 180 volts. The foregoing voltages are provided for example purposes only are not intended to be limiting. In view of the foregoing, it should be appreciated that in some embodiments, each lamp may be independently controlled and/or energized with a unique duty cycle modulation or power.

FIG. 5 depicts an embodiment of a present drying system, i.e., system 100. System 100 comprises lamps 66, 68, 70, 72, 74, 76 and 78, cooling plenum 104, and exhaust skirt 106. Cooling plenum 104 introduces cooling air into drying region 108 to cool lamps 66, 68, 70, 72, 74, 76 and 78 and to assist with exhausting moist air from region 108. Air enters region 108 through perforated plate 110 comprising a plurality of through holes 111 above lamps 66, 68, 70, 72, 74, 76 and 78 and is exhausted from region 108 through skirt 106, duct 112 and subsequently out air exhaust 114. It should be appreciated that in some embodiments, skirt 106 is arranged about the entire perimeter of region 108. Exhausting air from region 108 has been found to minimize the transmission of moisture laden air into other portions of the printer system associated with drying system 100. It has been found that arranging lamps 66, 68, 70, 72, 74, 76 and 78 in the process direction, i.e., the direction indicated by unidirectional arrow 116, causes defects in the outputs of lamps 66, 68, 70, 72, 74, 76 and 78, e.g., attenuation due to dark spots, to integrate out and thereby not affect the overall drying of the liquid ink passing under lamps 66, 68, 70, 72, 74, 76 and 78. Lamps oriented in a cross process direction, e.g., as depicted in FIG. 1, can result in drying streaks that produce mottled and/or irregular drying due to dark spots, which could in turn leave undesirable buildup of ink in systems subsequent to drying system 100, e.g., on decurler shafts and pitch rollers (not shown).

It should be appreciated that media sinks heat away from the transport system when present in and/or on the transport system. Thus, if media covers a particular transport belt, e.g., any of belts 117, that belt is protected from overheating, while transport belts that are exposed, i.e., media does not cover one or more belts, will be irradiated and thereby degraded over time. Typically, transport belts under media reach approximately 65 to 105° C. in steady state. If the transport belts are directly exposed to irradiation, their temperatures can reach 170° C. In short, approximately 50% of the energy from the lamps is absorbed into the media thereby prolonging the useful life of belts under the media.

Figure 6:
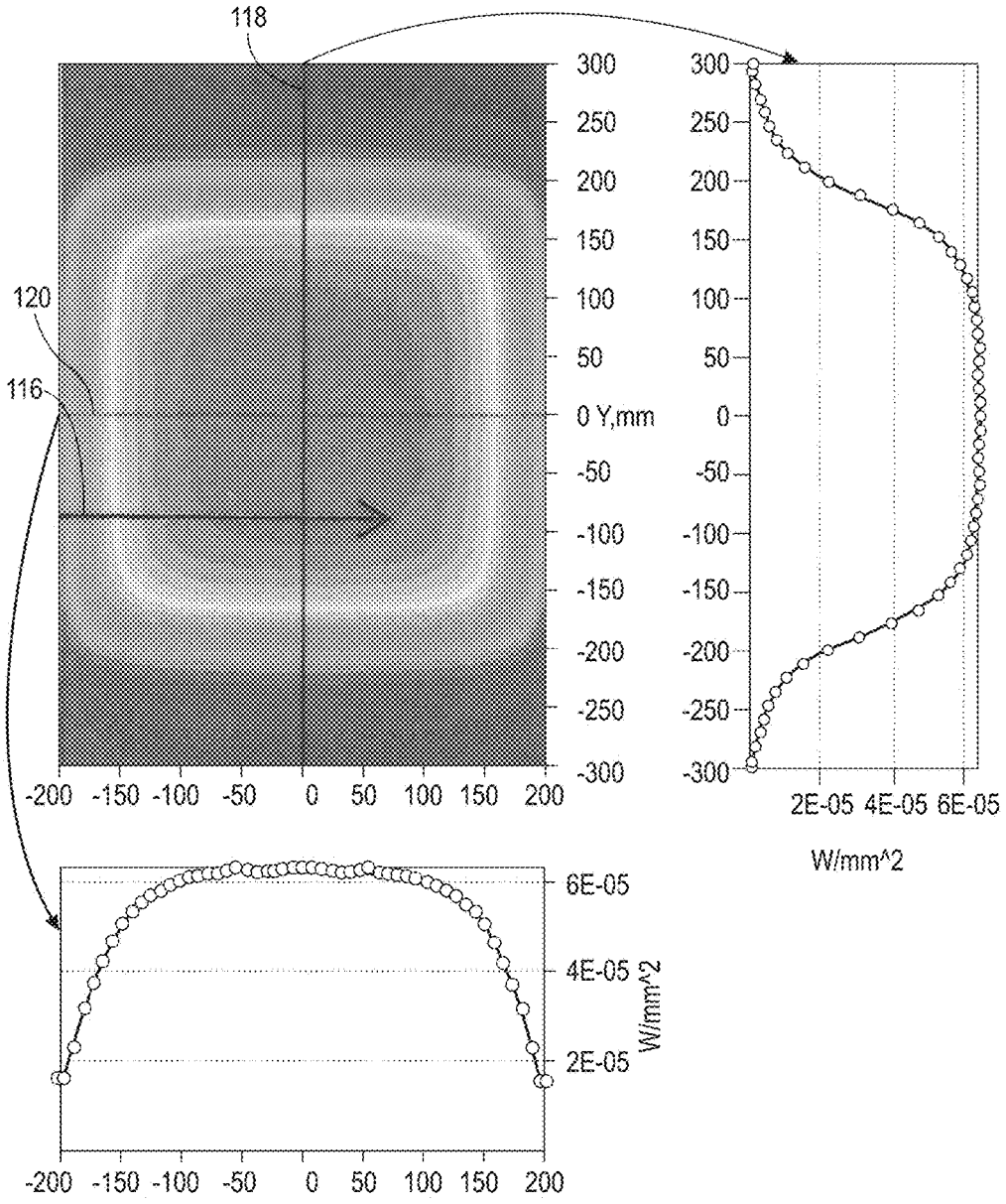
FIG. 6 is a ray trace of the energy output of process direction system 100 at the top left, a graphical representation of irradiance taken generally along line 118 of FIG. 6 at the top right (the cross process direction), and a graphical representation of irradiance taken generally along line 120 of FIG. 6 at the bottom (the process direction); and, FIG. 7 is a schematic diagram showing an embodiment of a printing system including a present system for drying liquid ink printed on a media.

FIG. 6 depicts a ray trace of the energy output of process direction lamp oriented system 100 at the top left, depicts a graphical representation of irradiance taken generally along line 118 of FIG. 6 at the top right (the cross process direction), and depicts a graphical representation of irradiance taken generally along line 120 of FIG. 6 at the bottom (the process direction). Arrow 116 depicts the process direction. Lamps 66, 68, 70, 72, 74, 76 and 78 are arranged at a 53 mm pitch and 43 mm away from the printed media. As is clearly depicted in the graphical representations, substantially uniform irradiance occurs between lamps 66, 68, 70, 72, 74, 76 and 78 in the cross process direction, i.e., the graphical representation shown at the bottom of FIG. 6. Moreover, irradiance fall off near the ends in the process direction, i.e., the graphical representation shown in the upper right of FIG. 6, are integrated out due to the orientation of lamps 66, 68, 70, 72, 74, 76 and 78 and the exposure of the printed media to the entire length of each of lamps 66, 68, 70, 72, 74, 76 and 78. Thus, the irradiance produced in system 100 provides substantially even temperature gradients across the printed media in both process and cross process directions.

Figure 7:
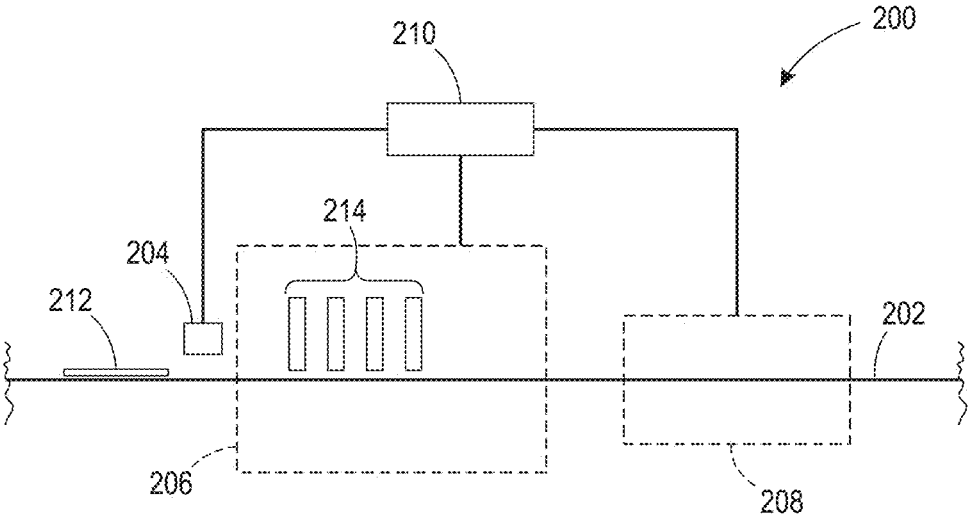

FIG. 7 is a schematic diagram showing an embodiment of a printing system, i.e., system 200, including a present system for drying liquid ink printed on a media. System 200 broadly comprises transport 202, detector 204, print engine 206, dryer 208 and control system 210. Transport 202 is a conventional cut sheet transport system; however, it is within the scope of the disclosure to utilize other transport systems, e.g., a transport system arranged to move a continuous web such as a roll of paper. Media 212 is moved through system 200 by transport 202. Detector 204 may be included to measure the size of media 212 for subsequent use within the system, e.g., controlling where ink is dispensed from printhead array 214, which lamps are turned on in dryer 208, etc. It should be appreciated that media sizes may be measured by detector 204, may be known in advance due to data included with a print job or may be measured by sensors located earlier in system 200. In addition to receiving information from detector 204, control system 210 turns on and off lamps in dryer 208 as needed provided sufficient time is available between media of different sizes. In short, some lamps require 3-4 second to power on, and their on/off switching may not be possible when media sizes vary more rapidly. Alternatively, control system 210 may predictively turn on or off lamps in dryer 208, e.g., a print job indicates that the tenth sheet is larger media so the lamp(s) is turned on as the fifth sheet passes the drying region thereby providing sufficient time for lamp power up. Additionally, control system 210 may control outer and inner lamp duty cycles as described above with respect to system 100. Printhead array 214 deposits a liquid ink on media 212 in print engine 206. Then transport 202 moves media 212 to dryer 208 wherein the liquid ink deposited on media 212 is dried. As described above with respect to system 100, dryer 208 includes one or more lamps oriented in a process direction, which lamps may be separately controlled, e.g., turned on/off or duty cycle increased/decreased. Moreover, system 200 may include jam detection sensors, e.g., trail/lead edge detectors at the entrance and exit of dryer 208, to ensure media does not reside in dryer 208 for too great of a length of time.

It should be appreciated that in some embodiments, the present lamp array, e.g., system 100, is used for drying liquid ink on a web in a printing apparatus, e.g., system 200. The web is arranged within system 200 in the same fashion as media 212 and transport 202; however, in embodiments used to dry a web, no transport system is needed. Thus, the web moves through printing apparatus 200 in a process direction. In these embodiments, the web moves via tension and does not require a transport; however, dryer 208 is more robust to unintended heating than in a system including a transport. It has been found that minimizing wasted heat outside the paper path is still advantageous. In some embodiments, lamp array 100 comprises at least one lamp, e.g., lamp 66, 68, 70, 72, 74, 76 and/or 78. The at least one lamp comprises a longitudinal axis arranged in a direction parallel to process direction 116 and in a region within the printing apparatus adjacent to the web, e.g., region 108.

The foregoing process direction oriented systems, e.g., system 100 and dryer 208, improves process and cross process directions irradiance uniformity. The arrangement also allows unnecessary lamps to be turned off, e.g., lamps unneeded for narrower width printed media. The foregoing arrangement reduces heating of exposed transport belts that receive flux from unnecessary lamps when printed media size does not require additional irradiance. Such an arrangement reduces power consumption and prolongs belt life, and in embodiments having a web fed, minimizes unneeded heating of the dryer enclosure outside of the paper path thus reducing power consumption.

It should be appreciated that the present system and method provides an improved means to dry liquid inks while prolonging the useful life of other components in the drying region of a printing system. It has been found that rotating the lamps to be parallel with the process direction of the printing system reduces lamp irradiance non-uniformities that arise from the lamp filament manufacturing processes, e.g., filaments cannot be manufactured perfect throughout. The present system allows inboard and outboard lamps to have their duty cycle increased and/or reduced to optimize the thermal gradient across the oven reflector cavity. The present system also allows inboard lamps to be turned on and/or off or duty cycle increased and/or reduced to optimize the thermal gradient across different widths of media. The ability to turn on and off and/or adjust the output of lamps reduces the direct exposure of vacuum transport belts, or other transport components, to irradiance when such belts are not covered by media. Moreover, the ability to turn on and off and/or adjust the output of inboard lamps reduces power consumption and decreases internal heating of dryer components. The present system and method minimizes the effects of lamp degradation as the process direction orientation of the lamps integrates out any variability of lamp output that occurs along the length of each lamp. Furthermore, lamps positioned adjacent/near the outboard and inboard edges of the drying region can be elevated in power duty cycle to balance the falloff in irradiance that typically occurs at the edges, i.e., the areas of the media closest to the outboard and inboard edges.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A lamp array for drying a liquid ink on a media in a printing apparatus, the printing apparatus comprising a transport system arranged to move the media through the printing apparatus in a process direction, the lamp array comprising:

a plurality of lamps, each lamp of the plurality of lamps having a longitudinal axis arranged in a direction parallel to the process direction and adjacent to the transport system; and, a perforated plate comprising a plurality of through holes and arranged between the plurality of lamps and a cooling plenum, wherein the plurality of lamps are equidistantly positioned substantially across a cross process distance of the transport system, and wherein the cooling plenum forms a drying region below the plurality of lamps and air passing from the cooling plenum through the perforated plate is distributed about the drying region.

2. The lamp array of claim 1 wherein each lamp of the plurality of lamps is equally spaced relative to each adjacent lamp.

3. A drying system for drying a liquid ink on a media in a printing apparatus, the printing apparatus comprising a transport system arranged to move the media through the printing apparatus in a process direction, the drying system comprising:

a plurality of lamps, each lamp of the plurality of lamps having a longitudinal axis arranged in a direction parallel to the process direction and adjacent to the transport system;

a cooling plenum arranged elevationally above and adjacent to the plurality of lamps;

an exhaust skirt arranged adjacent to the cooling plenum; and, a perforated plate comprising a plurality of through holes and arranged between the plurality of lamps and the cooling plenum, wherein the plurality of lamps are equidistantly positioned substantially across a cross process distance of the transport system, and wherein the cooling plenum forms a drying region below the plurality of lamps and air passing from the cooling plenum through the perforated plate is distributed about the drying region.

4. The drying system of claim 3 wherein each lamp of the plurality of lamps is equally spaced relative to each adjacent lamp.

5. The drying system of claim 3 wherein each lamp of the plurality of lamps is independently controlled.

6. The drying system of claim 3 wherein at least one lamp of the plurality of lamps is energized with a unique duty cycle.

7. The drying system of claim 3 further comprising:

a duct in fluid communication with the exhaust skirt; and, an air exhaust in fluid communication with the duct, wherein the cooling plenum forms a drying region below the plurality of lamps, air passes from the drying region through the exhaust skirt to the duct and from the duct to the air exhaust.

8. The drying system of claim 3 wherein the cooling plenum forms a drying region below the plurality of lamps and the exhaust skirt is arranged outside of the drying region.

9. A lamp array for drying a liquid ink on a web in a printing apparatus, the web moving through the printing apparatus in a process direction, the lamp array comprising:

a plurality of lamps, each lamp of the plurality of lamps having a longitudinal axis arranged in a direction parallel to the process direction and in a region within the printing apparatus adjacent to the web; and, a perforated plate comprising a plurality of through holes and arranged between the plurality of lamps and a cooling plenum, wherein the plurality of lamps are equidistantly positioned substantially across a cross process distance of the region, and wherein the cooling plenum forms a drying region below the plurality of lamps and air passing from the cooling plenum through the perforated plate is distributed about the drying region.

10. The lamp array of claim 9 wherein each lamp of the plurality of lamps is equally spaced relative to each adjacent lamp.

* * * * *